US005095879A

United States Patent [19]

Matsushima

[11] Patent Number: 5,095,879

[45] Date of Patent: Mar. 17, 1992

[54] ELECTRICALLY CONTROLLED FUEL INJECTION SYSTEM FOR INTERNAL COMBUSTION ENGINES

[75] Inventor: Seiya Matsushima, Wako, Japan

[73] Assignee: Honda Giken Kogyo K.K. (Honda Motor Co., Ltd. in English), Tokyo, Japan

[21] Appl. No.: 629,430

[22] Filed: Dec. 18, 1990

[30] Foreign Application Priority Data

Jan. 30, 1990 [JP] Japan ..... 2-20318
Jul. 11, 1990 [JP] Japan ..... 2-184576

[51] Int. Cl.[5] ..... F02M 37/04; F02G 5/00
[52] U.S. Cl. ..... 123/501; 123/557
[58] Field of Search ..... 123/557, 447, 500, 501, 123/497; 239/133, 135, 136; 73/61 R, 724

[56] References Cited

U.S. PATENT DOCUMENTS 3,762,378 10/1973 Bitoni ..... 123/557
3,868,939 3/1975 Friese ..... 123/557
3,999,525 12/1976 Stumpp ..... 123/557
4,137,872 2/1979 Loflin ..... 123/557
4,300,514 11/1981 Schaich ..... 123/557
4,458,655 7/1984 Oza ..... 123/557
4,665,881 5/1987 Wade ..... 123/557
4,823,757 4/1989 Redele ..... 123/557
4,886,032 12/1989 Asmus ..... 123/557
4,898,142 2/1990 Van Wechem ..... 123/557

FOREIGN PATENT DOCUMENTS 2145153 3/1985 United Kingdom ..... 123/557

*Primary Examiner*—Carl Stuart Miller
*Attorney, Agent, or Firm*—Arthur L. Lessler

[57] ABSTRACT

An electronically controlled fuel injection system for an internal combustion engine comprises a fuel supply source, at least one fuel passage in the form of a nozzle disposed to be supplied with fuel from the fuel supply source, and a heater arranged in each of the at least one fuel passage for heating fuel in each fuel passage to generate a bubble therein so that pressure of the fuel therein is increased, whereby the fuel in each fuel passage is injected into the intake passage of the engine through an injection port of each fuel passage.

19 Claims, 8 Drawing Sheets

ELECTRICALLY CONTROLLED FUEL INJECTION SYSTEM FOR INTERNAL COMBUSTION ENGINES

BACKGROUND OF THE INVENTION

This invention relates to an electronically controlled fuel injection system for injecting fuel into the intake system of an internal combustion engine.

A conventional electronically controlled fuel injection system has a basic construction as shown in FIG. 1. As shown in the figure, a throttle valve 4 is arranged in an intake pipe 3, the interior of which communicates with a combustion chamber 2 of an internal combustion engine 1, and a fuel injector 5 is provided downstream of the throttle valve 5. The fuel injector 5 is connected to a fuel pump 7 via a fuel supply pipe 8 to pressure deliver fuel from a fuel tank 6 to the fuel injector 5. A pressure regulator 9 is arranged across the fuel supply pipe 8 to regulate the pressure of fuel. Further, the system also includes an intake pressure sensor 10 for detecting intake pressure ($P_B$) in the intake pipe 3 at a location downstream of the throttle valve 4 and an engine rotational speed sensor 11 for detecting the rotational speed (Ne) of the engine 1. Signals from these sensors are supplied to an electronic control unit (hereinafter referred to as "the ECU") 12. The ECU 12 controls the amount of fuel injected by the fuel injector 5 based on the detected values of the intake pressure ($P_B$) and the engine rotational speed (Ne).

In the conventional fuel injection system, the fuel pump 7 is required to achieve high delivery pressure in order to secure a predetermined injection pressure (e.g. 2.5 kg/cm$^2$), which results in an large size of the fuel pump 7 as well as a high manufacturing cost.

In the meanwhile, it has been proposed, by Japanese Provisional Patent Publication (Kokai) No. 63-170557 and Japanese Provisional Patent Publication (Kokai) No. 56-9653, for example, to arrange the nozzle of the fuel injector such that it faces a venturi formed in an intake passage of the engine, to thereby make the fuel pump 7 smaller in size or dispense therewith. However, the proposed fuel injection systems have the inconvenience that it is very difficult to control the amount of fuel injection.

SUMMARY OF THE INVENTION

It is an object of the invention to provide an electronically controlled fuel injection system which is capable of injecting an appropriate amount of fuel into the intake passage of the engine without employing a fuel pump or a pressure regulator.

It is a further object of the invention to provide an electronically controlled fuel injection system which is capable of positively filling a fuel passage in the form of a nozzle thereof with fuel, to thereby improve the startability of the engine.

To attain the first-mentioned object, the present invention provides an electronically controlled fuel injection system for an internal combustion engine having an intake passage into which fuel is injected under pressure.

The electronically controlled fuel injection system according to the invention comprises:

a fuel supply source;

at least one fuel passage in the form of a nozzle disposed to be supplied with fuel from the fuel supply source, each of the at least one fuel passage having an injection port at one end thereof, the injection port being located in the intake passage for injecting fuel thereinto; and a heater arranged in each of the at least one fuel passage for heating fuel in the each fuel passage to generate a bubble therein so that pressure of the fuel therein is increased, whereby the fuel in the each fuel passage is injected into the intake passage through the injection port.

Preferably, the system includes a one-way valve normally biased to close the injection port.

More preferably, the system includes a second one-way valve arranged upstream of the heater in the each fuel passage for allowing fuel to flow only in such a direction as to be introduced into the each fuel passage.

In a preferred form of the invention, the system includes a sensor for detecting presence of fuel in the at least one fuel passage.

Preferably, the sensor is arranged in the at least one fuel passage at a side upstream of the heater.

More preferably, the sensor detects electrostatic capacity dependent on whether or not fuel is present in the at least one fuel passage.

Preferably, the system includes pump means for forcedly supplying fuel to the each fuel passage from the fuel supply source, when the sensor detects that there is not a sufficient amount of fuel in the at least one fuel passage.

The above and other objects, features, and advantages of the invention will become more apparent from the ensuing detailed description taken in conjunction with the accompanying drawings.

BRIEF DESCRIPTION OF THE DRAWINGS

(*a*) to (*e*) of FIG. 7 are diagrams useful in explaining the operation of the fuel injector.

DETAILED DESCRIPTION

The invention will now be described in detail with reference to the drawings showing embodiments thereof.

Figure 1:
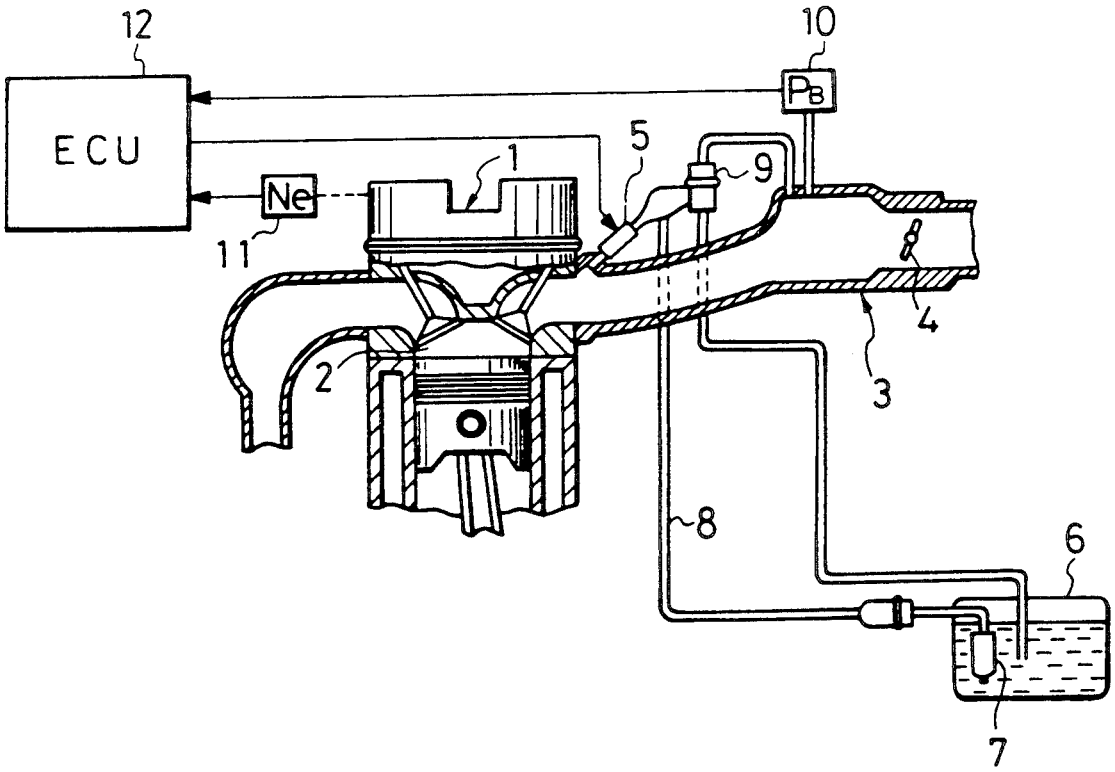
FIG. 1 is a schematic diagram of a conventional electronically controlled fuel injection system.
Figure 2:
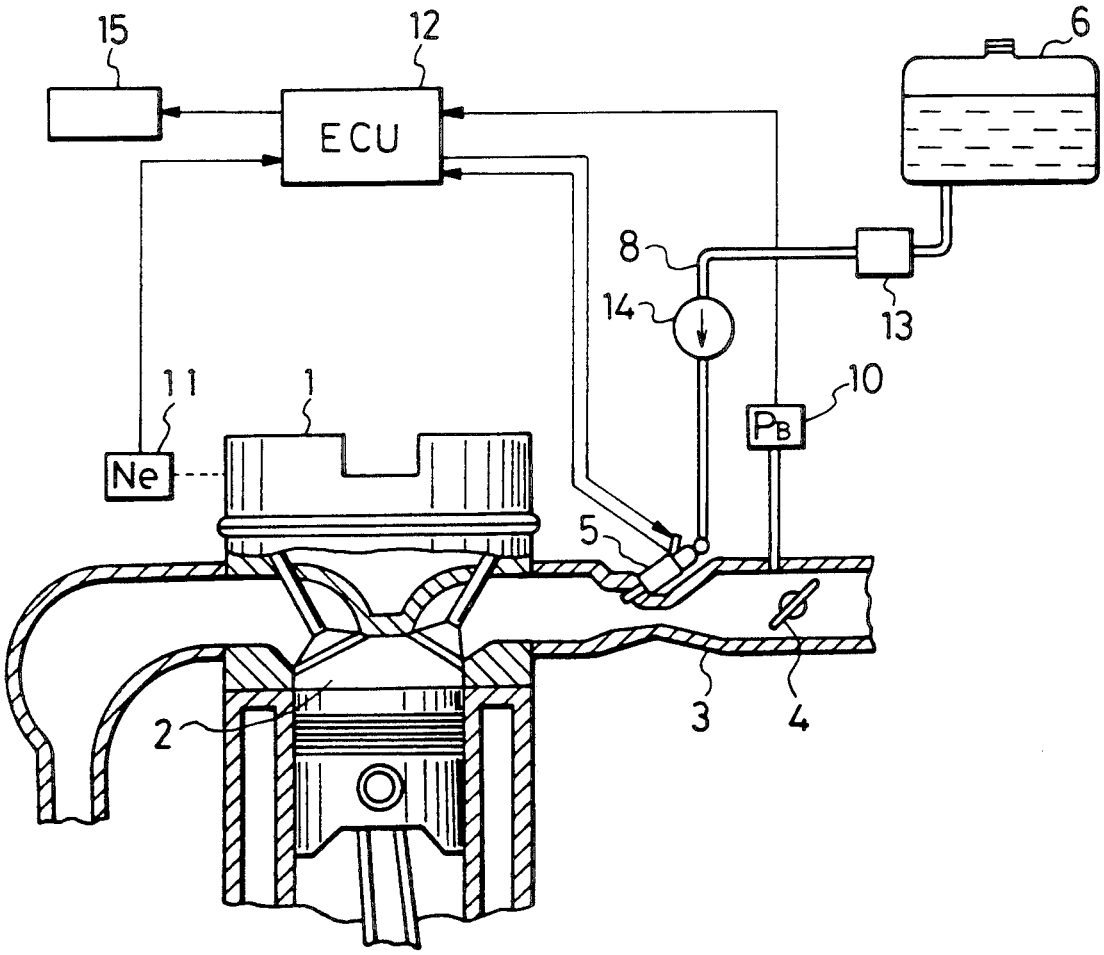
FIG. 2 is a schematic diagram of the whole arrangement of an electronically controlled fuel injection system according to a first embodiment of the invention.

FIG. 2 shows the whole arrangement of an electronically controlled fuel injection system according to a first embodiment of the invention. Component parts corresponding to those of the prior art shown in FIG. 1 are designated by identical reference numerals. In FIG. 2, a fuel injector 5 is connected to a fuel tank 6 via a fuel supply pipe 8. There are provided no component parts corresponding to the fuel pump 7 and the pressure regulator 9 in FIG. 1. A fuel filter 13 and a manually-operated pump 14 are arranged at intermediate portions of the fuel supply pipe 8. The manually-operated pump 14 is constructed such that it can allow fuel to continue flowing in one direction even when it is not in operation. Further, a fuel sensor 26 (see FIG. 3), referred to hereinafter, is provided within the fuel injector 5, and supplies a signal indicative of the presence or absence of fuel to the ECU 12, to which is connected an indicator 15 for indicating the presence or absence of fuel detected by the fuel sensor 26.

The other elements and parts, not referred to above, are arranged and constructed similarly to the prior art of FIG. 1.

Figure 3:
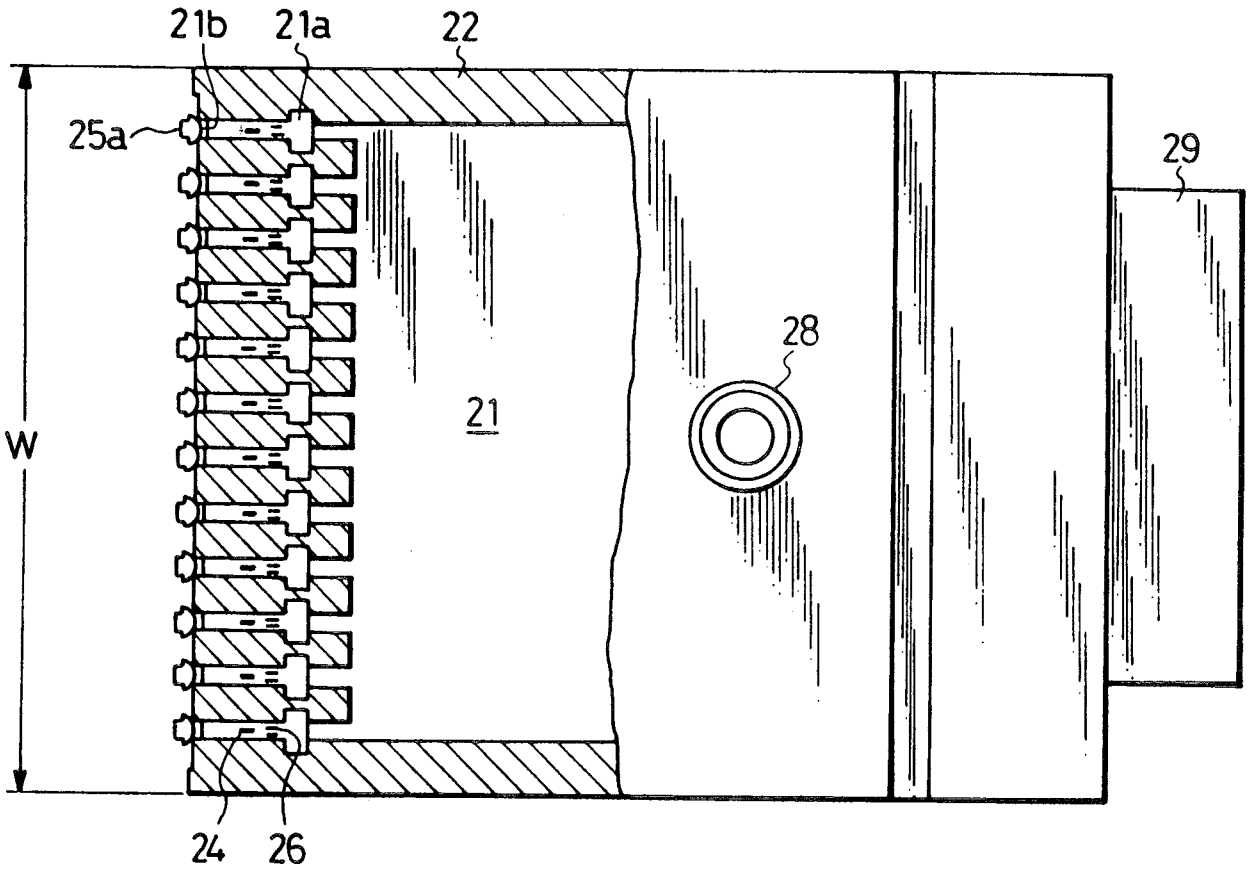
FIG. 3 is a plan view of a fuel injector, with essential parts thereof shown in section.
Figure 4:
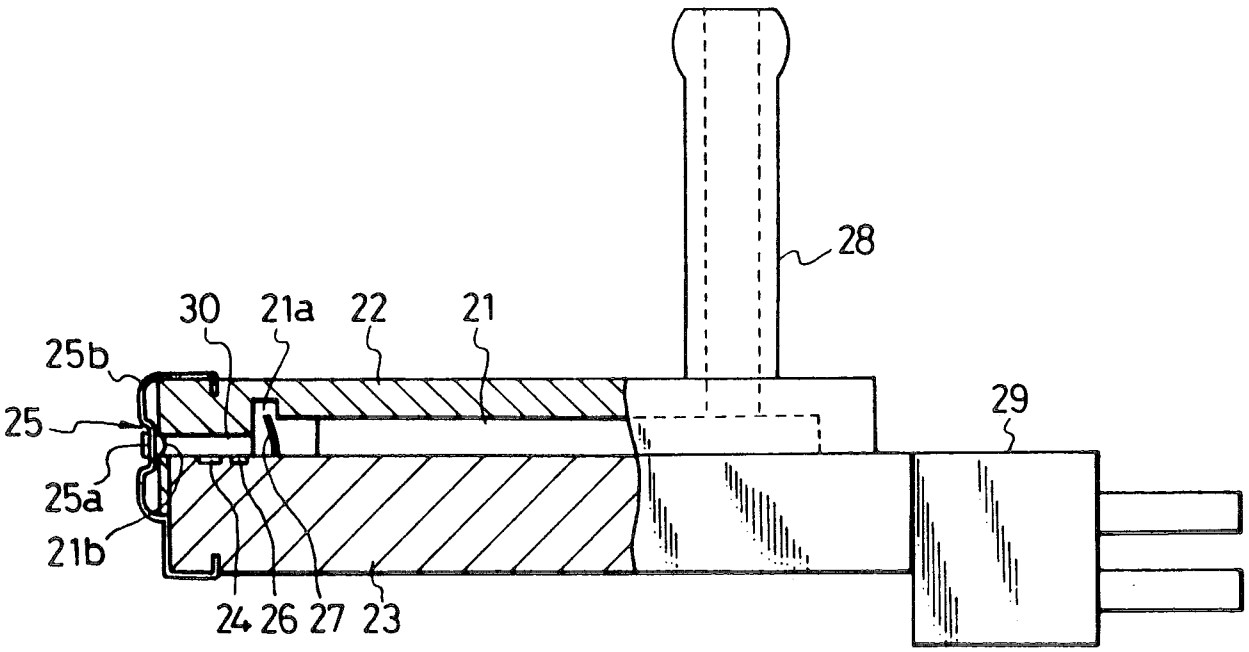
FIG. 4 is a side view of the fuel injector, with essential parts thereof shown in section.
Figure 5:
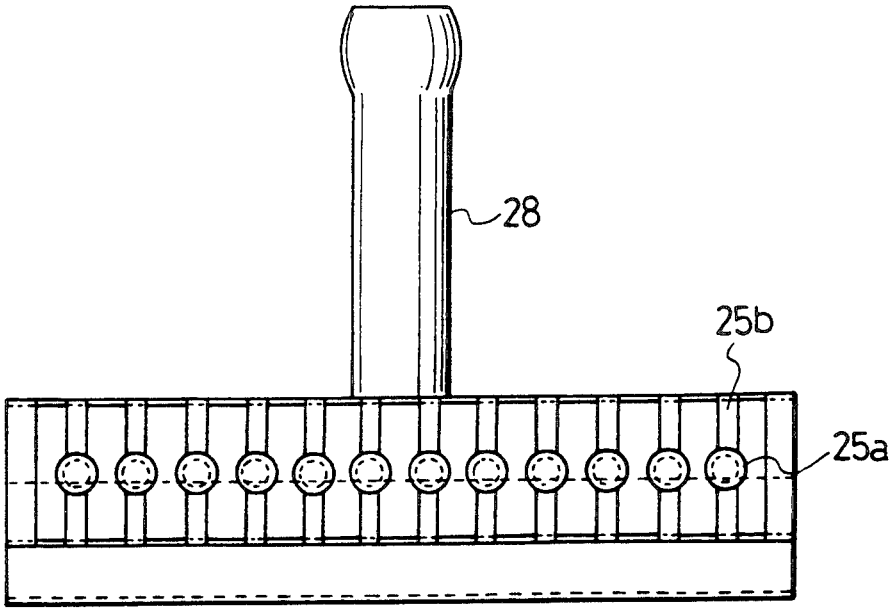
FIG. 5 is a front view of the fuel injector.

FIGS. 3 to 5 show the fuel injector 5, with essential parts thereof shown in section.

A base plate 23 and a covering plate 22 define a fuel supply chamber 21 and a plurality of, e.g. twelve, fuel passages 21*a*, each being in the form of a nozzle, which fork from the fuel supply chamber 21. The fuel supply chamber 21 communicates with a connector 28 to which is connected the fuel supply passage 8. Each fuel passage 21*a* has an injection port 21*b* having a circular cross-section and formed at its front end (the left end as viewed in FIG. 3 or 4). Fitted into a front end of the injection port 21*b* is a pressure-regulating valve (which creates a pressure of, e.g. 1 kg/cm$^2$) 25 which is composed of a valve body 25*a*, and a leaf spring 25*b*, and acts as a one-way valve (first one-way valve). The valve body 25*a* is normally biased by the leaf spring in a valve-closing direction (rightward as viewed in FIG. 3 or 4), and closes the injection port 25*b* except when the fuel should be injected. A one-way valve (second one-way valve) 27 formed by a reed is arranged in the fuel passage 21*a*, and defines an injection chamber 30 in the fuel passage 21*a* when the valve 27 is closed. The one-way valve 27 opens only in a direction in which fuel is allowed to flow into the injection chamber 30 from the fuel supply chamber 21.

Figure 6A:
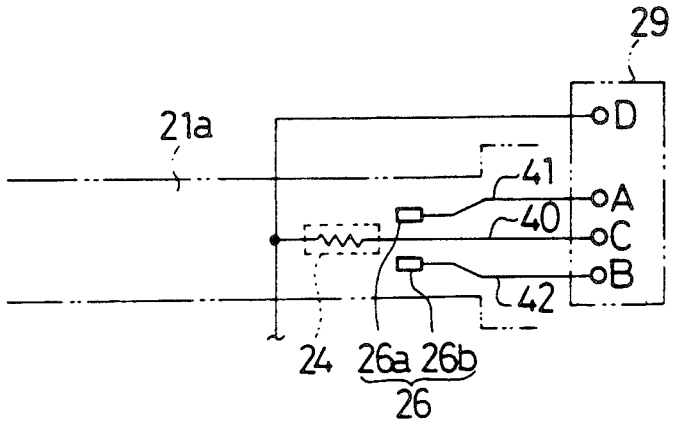
FIGS. 6*a* and 6*b* are schematic diagrams of examples of the construction of a fuel sensor.
Figure 6B:
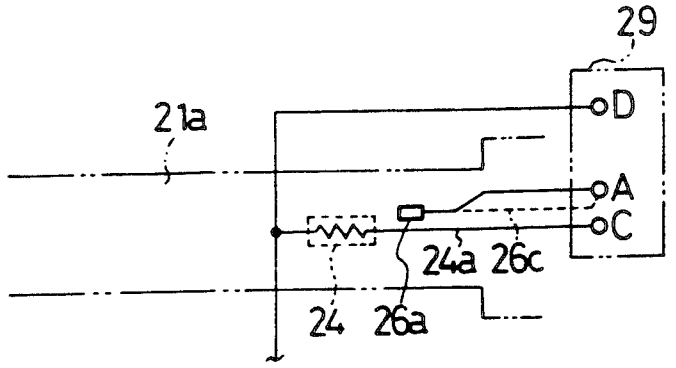

Further, an electric heater 24 is embedded in a surface portion of the base plate 23 defining the fuel injection chamber 30, and the fuel sensor 26 comprising detecting elements 26*a* and 26*b* (FIG. 6*a*) is embedded in the same surface portion at a side upstream of the electric heater 24. The electric heaters 24 and the fuel sensors 26 are connected to a connector 29, as shown in FIGS. 6*a* and 6*b*, by a wiring pattern 40, 41 and 42 formed on the base plate 23. In FIG. 6*a*, D designates an earthing terminal, C an input terminal for supplying the electric heater 24 with a pulse signal for turning it on and off, and A and B are terminals connected to the detecting elements 26*a* and 26*b* of the fuel sensor for applying thereto AC voltage or DC ripple voltage (hereinafter referred to as "the detecting voltage") to thereby detect electrostatic capacity therebetween. These terminals A to D are connected to the ECU 12.

The electrostatic capacity between the detecting elements 26*a* and 26*b* varies in dependence on whether or not there is fuel therebetween. Therefore, a change in the electrostatic capacity can be detected from a change in the detecting voltage applied thereto.

FIG. 6*b* shows another example of the construction of the fuel sensor 26. According to this construction, the presence of fuel is detected from the electrostatic capacity between a line 24*a* for applying voltage to the electric heater 24 and the detecting element 26*a* of the fuel sensor 26. In this case, the voltage of the pulse signal applied to the electric heater 24 is used as the detecting voltage. Further, the detecting element 26*a* may be omitted. Instead, a line 26*c* may be provided and arranged closely to the line 24*a* as shown by the broken line in FIG. 6*b*, to detect the presence or absence of fuel from the electrostatic capacity between the lines 24*a* and 26*c*.

The above described construction of the fuel sensor 26 makes it possible to collectively form the electric heaters 24 and the wiring pattern therefor at the time of manufacturing the base plate, to thereby restrain increase in the manufacturing cost due to the provision of the sensors 26.

The electric heater 24, the pressure-regulating valve 25, the fuel sensor 26, and the one-way valve 27 are provided in each of the tweleve fuel passages 21*a*. The terminals A to C are provided in each pair of an electric heater 24 and a fuel sensor 26. Therefore, the twelve electric heaters can be controlled by respective pulse signals such that each of the heaters is truned on and off independently of others, and the presence or absence of fuel can be detected for each of the fuel passages 21*a*. Further, in this embodiment, the base plate 23 is formed of $Al_2O_3$, the electric heater 24 $ZrB_2$, the valve body 25*a* of the pressure-regulating valve 25 fluororubber, the one-way valve 27 polypropylene, and the leaf spring 25*b* stainless steel. The width W of the fuel injector in FIG. 2 is approximately 40 mm, and the transverse cross-section of the injection chamber 30 is in the form of a true square having a size of approximately 1 mm×1 mm.

The fuel sensor 26 need not be provided in each fuel passage 21*a*, but may be provided only in part of the fuel passages 21*a*.

The fuel injector having the above described construction is inserted into the intake pipe 3 with the injection port 21*b* located within the intake pipe 3. The fuel supply pipe 8 is connected to the connector 28, and the connector 29 is electrically connected to the ECU 12. The ECU 12 supplies a pulse signal (hereinafter referred to as "the injection pulse(s)") to each electric heater 24 to inject fuel into the intake pipe as described hereinafter.

Figure 7:
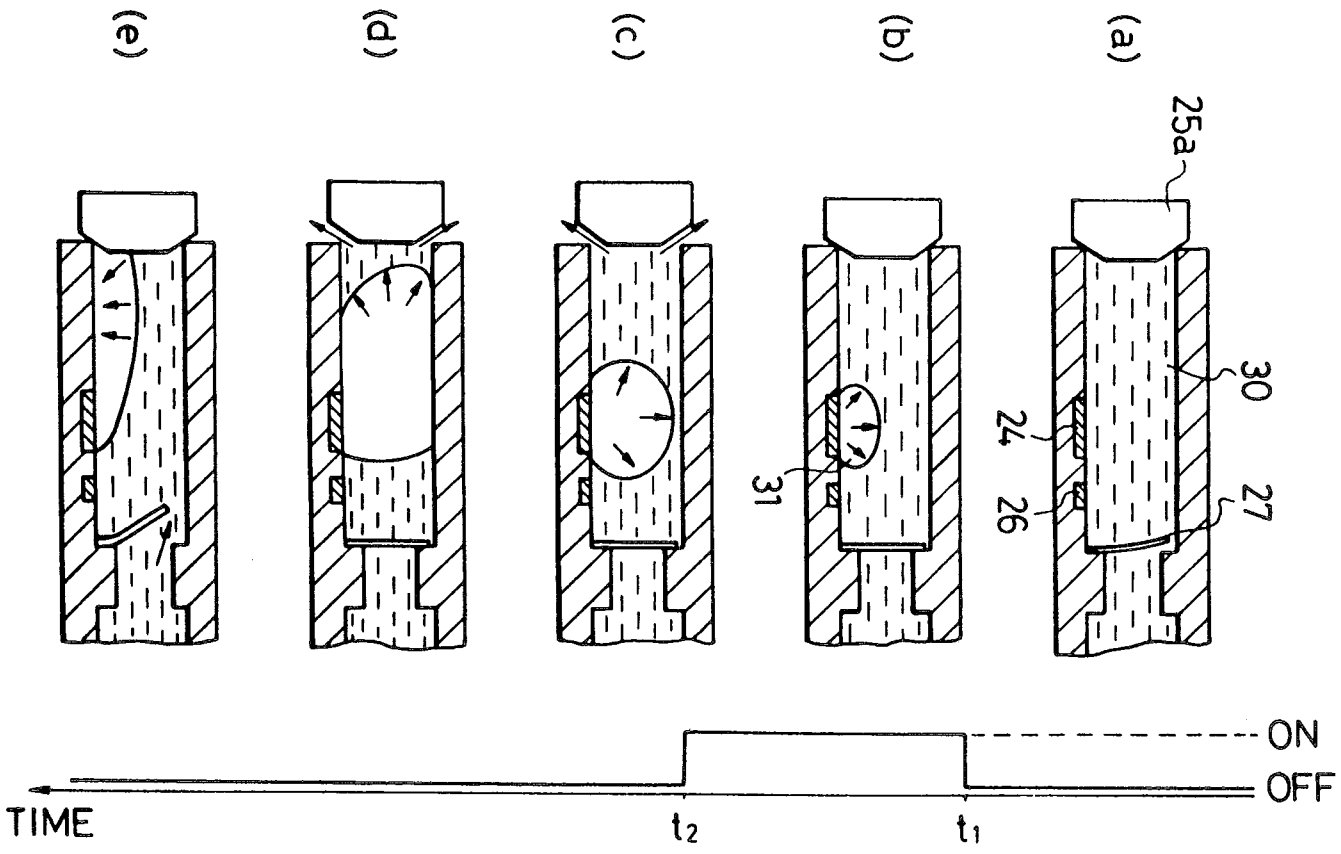

FIG. 7 shows the operating principle of the fuel injector 5. (a) of FIG. 7 shows a state in which the injection pulse has not been supplied to the electric heater 24 yet. As shown in the right side of the figure, the electric heater 24 is energized from a time point $t_1$ to a time point $t_2$. Upon energization of the electric heater 24, the temperature of a portion of fuel in contact with the surface of the electric heater 24 rises immediately to cause film boiling so that a bubble 31 is generated and developed. Accordingly, the one-way valve 27 is closed, and the pressure within the injection chamber 30 rises ((*b*) of FIG. 7). When the bubble 31 grows to cause the pressure within the injection chamber 30 to exceed the pressure given by the pressure-regulating valve 25, the pressure-regulating valve 25 opens to start fuel injection ((*c*) of FIG. 7). Thereafter, the bubble 31 further grows to deliver all the fuel on the pressure-regulating valve side of the bubble 31 ((*d*) of FIG. 7). At this time point, the electric heater 24 has already ceased to be energized, so that the boundary of the bubble 31 and the fuel cools off to contract the bubble 31. Accordingly, the pressure within the injection chamber 30 decreases to close the pressure-regulating valve 25, and at the same time the one-way valve 27 opens. As a result, fuel flows into the injection chamber 30 ((*e*) of FIG. 7).

Thus, according to the fuel injector 5 of the present invention, fuel under high pressure is injected from the injection chamber 30 into the intake pipe 3, while fuel to be injected next is absorbed into the injection chamber 30. Therefore, provision of a fuel pump for applying high pressure to fuel and a pressure regulator is not required to supply fuel to the fuel injector and inject fuel into the intake pipe, and hence the manufacturing cost can be reduced. Further, it is possible to accurately and easily control the fuel injection amount by varying the frequency of generation of the injection pulses or the pulse duty factor thereof. Moreover, it is possible to control the fuel injection amount by changing the number of injection chambers which carry out fuel injection (hence the number of electric heaters to which injection pulses are supplied), and hence it is possible to inject fuel more uniformly into the intake pipe by increasing the number of injection chambers. Although the pressure within the intake pipe, i.e. the intake pressure $P_B$ is lower than atmospheric pressure during operation of the engine, the pressure-regulating valve 25 acts to prevent fuel from leaking into the intake pipe and increase the pressure of fuel injected.

Further, since the arrangement of the fuel sensor 26 at a location upstream of the electric heater 24 makes it possible to avoid erroneously detecting due to the bubble 31 that fuel is absent.

When fuel is not present in the injection chamber 30, e.g. at the start of the engine, the fuel sensor 26 detects the absence of fuel and the indicator 15 informs the driver of the state of the injection chamber 30. On such an occasion, the driver can manually operate the manually-operated pump 14 to supply fuel to the injection chamber 30 and make sure by the indicator 15 whether the injection chamber 30 is filled with fuel. If it is recognized that it is filled with fuel, the electric heater 24 is energized to carry out fuel injection as shown in FIG. 7, which leads to improved startability of the engine. In addition, in this embodiment, the indicator 15 carries out its fuel absence-informing operation when fuel is not present in at least one of the twelve injection chambers 30.

Figure 8:
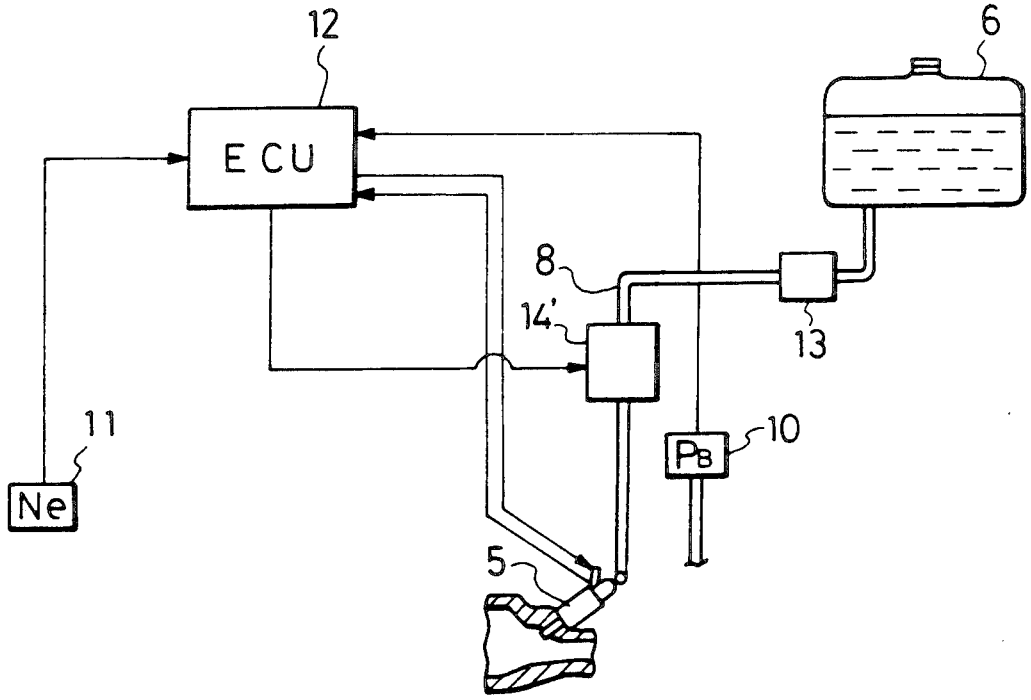
FIG. 8 is a schematic diagram of the arrangement of an electronically controlled fuel injection system according to a second embodiment of the invention.

FIG. 8 shows a second embodiment of the invention. In the figure, only essential parts of the second embodiment are shown, which are modified ones of parts of the electronically controlled fuel injection system shown in FIG. 2. The omitted parts are identical to those in FIG. 2. In FIG. 8, instead of the manually-operated pump 14, there is provided a small low pressure electric pump 14' which is connected to the ECU 12. In this embodiment, the indicator 15 is not used.

In the second embodiment, when at least one of the fuel sensors 26 within the fuel injectors 5 detects absence of fuel in at least one corresponding injection chamber 30, the ECU 12 causes the electric pump 14' to operate to supply fuel to the injection chambers 30. After it is made sure by the fuel sensor 26 that fuel is present in the injection chambers 30, the operation of the electric pump 14' is stopped. Thus, similarly to the first embodiment, the startability of the engine is improved.

The electric pump 14' is not required to be large in size or achieve high delivery pressure as distinct from the fuel pump used in the conventional electronically controlled fuel injection system, but is only required to have the function of supplying fuel to the injection chambers 30.

What is claimed is:

1. An electronically controlled fuel injection system for an internal combustion engine having an intake passage into which fuel is injected under pressure, said system comprising:

a fuel supply source;

at least one fuel passage in the form of a nozzle disposed to be supplied with fuel from said fuel supply source, each of said at least one fuel passage having an injection port at one end thereof, said injection port being located in said intake passage for injecting fuel thereinto;

a heater arranged in each of said at least one fuel passage for heating fuel in said each fuel passage to generate a bubble therein so that pressure of said fuel therein is increased, whereby said fuel in said each fuel passage is injected into said intake passage through said injection port; and control means for controlling the operation of said heater by supplying a variable pulse signal thereto, wherein said control means varies said variable pulse signal for controlling a fuel injection amount from said injection port.

2. An electronically controlled fuel injection system according to claim 1, including a one-way valve normally biased to close said injection port.

3. An electronically controlled fuel injection system according to claim 2, including a second one-way valve arranged upstream of said heater in said each fuel passage for allowing fuel to flow only in such a direction as to be introduced into said each fuel passage.

4. An electronically controlled fuel injection system for an internal combustion engine having an intake passage into which fuel is injected under pressure, said system comprising:

a fuel supply source;

at least one fuel passage in the form of a nozzle disposed to be supplied with fuel from said fuel supply source, each of said at least one fuel passage having an injection port at one end thereof, said injection port being located in said intake passage for injecting fuel thereinto;

a sensor for detecting the presence of fuel in said at least one fuel passage; and a heater arranged in each of said at least one fuel passage for heating fuel in said each fuel passage to generate a bubble therein so that pressure of said fuel therein is increased, whereby said fuel in said each fuel passage is injected into said intake passage through said injection port.

5. An electronically controlled fuel injection system according to claim 4, wherein said sensor is arranged in said at least one fuel passage at a side upstream of said heater.

6. An electronically controlled fuel injection system according to claim 4 or 5, wherein said sensor detects electrostatic capacity dependent on whether or not fuel is present in said at least one fuel passage.

7. An electronically controlled fuel injection system according to claim 6, wherein said sensor comprises two detecting elements arranged within said at least one fuel passage, for detecting electrostatic capacity therebetween.

8. An electronically controlled fuel injection system according to claim 6, in cluding a line for applying voltage to said heater and wherein said sensor comprises a single detecting element for detecting electrostatic capacity between said line and said single detecting element.

9. An electronically controlled fuel injection system according to claim 4, 5, or 6, including pump means for forcedly supplying fuel to said each fuel passage from said fuel supply source, when said sensor detects that there is not a sufficient amount of fuel in said at least one fuel passage.

10. An electronically controlled fuel injection system according to claim 9, wherein said pump means is a manually-operated pump.

11. An electronically controlled fuel injection system according to claim 9, wherein said pump means is an electric pump.

12. An electronically controlled fuel injection system for an internal combustion engine having an intake passage into which fuel is injected under pressure, said system comprising:

a fuel supply source;

at least one fuel passage in the form of a nozzle disposed to be supplied with fuel from said fuel supply source, each of said at least one fuel passage having an injection port at one end thereof, said injection port being located in said intake passage for injecting fuel thereinto;

a heater arranged in each of said at least one fuel passage for heating fuel in said each fuel passage to generate a bubble therein so that pressure of said fuel therein is increased, whereby said fuel in said each fuel passage is injected into said intake passage through said injection port; and a sensor for detecting presence of fuel in said at least one fuel passage.

13. An electronically controlled fuel injection system according to claim 12, including a one-way valve normally biased to close said injection port.

14. An electronically controlled fuel injection system according to claim 13, including a second one-way valve arranged upstream of said heater in said each fuel passage for allowing fuel to flow only in such a direction as to be introduced into said each fuel passage.

15. An electronically controlled fuel injection system according to claim 12, including control means for controlling the operation of said heater by supplying a pulse signal thereto, and wherein said control means varies the frequency of said pulse signal for controlling a fuel injection amount from said injection port.

16. An electronically controlled fuel injection system according to claim 12, including control means for controlling the operation of said heater by supplying a pulse signal thereto, and wherein said control means varies the pulse duty factor of said pulse signal for controlling a fuel injection amount from said injection port.

17. An electronically controlled fuel injection system according to claim 1 or 12, including a plurality of fuel passages, a plurality of heaters arranged respectively in said fuel passages, and control means for controlling the operation of said heaters independently of each other, by supplying respective control signals to said heaters.

18. An electronically controlled fuel injection system according to claim 1, wherein said control means varies the frequency of said pulse signal for controlling a fuel injection amount from said injection port.

19. An electronically controlled fuel injection system according to claim 1, wherein said control means varies the pulse duty factor of said pulse signal for controlling a fuel injection amount from said injection port.

* * * * *